US008368629B2

(12) United States Patent
Jung et al.

(10) Patent No.: US 8,368,629 B2
(45) Date of Patent: Feb. 5, 2013

(54) LIQUID CRYSTAL DISPLAY

(75) Inventors: Yongchae Jung, Daegu (KR); Seungchul Park, Kyungbuk (KR); Sangjin Nam, Chungbuk (KR)

(73) Assignee: LG Display Co., Ltd., Seoul (KR)

( * ) Notice: Subject to any disclaimer, the term of this patent is extended or adjusted under 35 U.S.C. 154(b) by 576 days.

(21) Appl. No.: 12/506,562

(22) Filed: Jul. 21, 2009

(65) Prior Publication Data

US 2010/0127960 A1 May 27, 2010

(30) Foreign Application Priority Data

Nov. 27, 2008 (KR) ..... 10-2008-0118953

(51) Int. Cl.
*G09G 3/36* (2006.01)

(52) U.S. Cl. ..... 345/89; 345/690; 345/209; 345/204; 345/94; 345/96; 349/85

(58) Field of Classification Search ..... 345/204–215, 345/87–104, 690, 94–96; 349/84–85, 173
See application file for complete search history.

(56) References Cited

U.S. PATENT DOCUMENTS 7,535,302 B2 * 5/2009 Nishimura et al. ..... 330/255
7,936,328 B2 * 5/2011 Furihata et al. ..... 345/96
7,990,357 B2 * 8/2011 Shin ..... 345/99
2002/0067326 A1 * 6/2002 Aoki ..... 345/89
2006/0284806 A1 * 12/2006 Maki ..... 345/89
2007/0211004 A1 * 9/2007 Yoshihara et al. ..... 345/87
2008/0180427 A1 * 7/2008 Nishimura ..... 345/209
2008/0198123 A1 * 8/2008 Moon et al. ..... 345/96
2008/0224984 A1 * 9/2008 Chang ..... 345/100
2008/0238898 A1 * 10/2008 Yamanaka et al. ..... 345/204
2008/0246718 A1 * 10/2008 Tanaka ..... 345/94
2009/0102831 A1 * 4/2009 Hashimoto ..... 345/214

* cited by examiner

*Primary Examiner* — Lun-Yi Lao
*Assistant Examiner* — Priyank Shah
(74) *Attorney, Agent, or Firm* — Morgan, Lewis & Bockius LLP

(57) ABSTRACT

This document relates to a liquid crystal display capable of improving picture quality by compensating for difference in charge between liquid crystal cells. The liquid crystal display comprises a liquid crystal display panel; a gate driving circuit; a charge difference compensation circuit configured to generate, in a specific gray level range, analog positive gamma voltages having a first reference level and analog negative gamma voltages having a second reference level in synchronization with a first scan time at which a first gate line is driven, and generate the analog positive gamma voltages having a first compensation level that is lower than the first reference level and the analog negative gamma voltages having a second compensation level that is higher than the second reference level in synchronization with a second scan time at which a second gate line is driven; and a data driving circuit.

4 Claims, 9 Drawing Sheets

LIQUID CRYSTAL DISPLAY

This application claims the benefit of Korean Patent Application No. 10-2008-0118953 filed on Nov. 27, 2008, which is incorporated herein by reference for all purposes as if fully set forth herein.

BACKGROUND

1. Field

This document relates to a liquid crystal display driven using a double rate driving (DRD) method, and more particularly, to a liquid crystal display which is capable of improving picture quality by compensating for difference in charge between liquid crystal cells.

2. Related Art

A liquid crystal display is configured to display images by controlling the light transmissivity of a liquid crystal layer using an electric field supplied to the liquid crystal layer in response to a video signal. The liquid crystal display is a flat panel display having the advantages of small size, slimness, and low power consumption, and is used in portable computers such as notebook PCs, office automation devices, audio/video devices, and so on. In particular, a liquid crystal display of an active matrix type in which a switching element is formed in each liquid crystal cell is advantageous for implementing motion pictures because it can actively control the switching elements.

A thin film transistor (hereinafter referred to as a "TFT"), as shown in FIG. 1, is generally used as the switching element for the active matrix type liquid crystal display.

Referring to FIG. 1, the active matrix type liquid crystal display is configured to convert digital video data into an analog data voltage on the basis of a gamma reference voltage, supply the converted data voltage to a data line DL and, at the same time, supply a scan pulse to a gate line GL, thereby charging a liquid crystal cell Clc with the data voltage. To this end, the gate electrode of a TFT is coupled to the gate line GL, the source electrode of the TFT is coupled to the data line DL, and the drain electrode of the TFT is coupled to the pixel electrode of the liquid crystal cell Clc and one of the electrodes of a storage capacitor Cst. A common voltage Vcom is supplied to the common electrode of the liquid crystal cell Clc. When the TFT is turned on, the storage capacitor Ct is charged with the data voltage supplied from the data line DL, thus functioning to constantly maintain the voltage of the liquid crystal cell Clc. When the scan pulse is supplied to the gate line GL, the TFT is turned on and a channel is formed between the source electrode and the drain electrode, so the voltage of the data line DL is supplied to the pixel electrode of the liquid crystal cell Clc. At this time, the arrangement of liquid crystal molecules of the liquid crystal cell Clc is changed by an electric field between the pixel electrode and the common electrode, so light incident on the liquid crystal cell is changed.

This liquid crystal display comprises a gate drive integrated circuit (IC) for driving the gate lines GL, and a data drive IC for driving the data lines DL. As the size and definition of liquid crystal displays increase, so does the required number of drive ICs. Because the data drive ICs are more expensive than other elements, several schemes for reducing the number of data drive ICs have recently been proposed. FIG. 2 shows one such scheme, a DRD method of implementing the same resolution as the conventional art by halving the number of data drive ICs in such a way as to double the number of gate lines but halve the number of data lines compared to the conventional art.

Referring to FIG. 2, the conventional liquid crystal display driven using the DRD method is configured to drive m (m is a natural number greater than or equal to 2) liquid crystal cells, arranged in one horizontal line, using two gate lines and m/2 data lines. The conventional liquid crystal display is configured to drive the data drive ICs using a 2-dot inversion method in order to minimize flicker and reduce power consumption. Accordingly, two neighboring liquid crystal cells with one data line between them are respectively coupled to two gate lines and charged with data voltages having the same polarity, supplied through the data line. For example, in a specific frame, an R liquid crystal cell and a G liquid crystal cell sharing a first data line D1, among liquid crystal cells arranged in a first horizontal line HL1, may be sequentially charged with positive voltages at the same time as scan pulses are supplied from respective gate lines G1 and G2, an R liquid crystal cell and a B liquid crystal cell sharing a second data line D2, among the liquid crystal cells, may be sequentially charged with negative voltages at the same time as scan pulses are supplied from the respective gate lines G1 and G2, and an R liquid crystal cell and a B liquid crystal cell sharing a third data line D3, among the liquid crystal cells, may be sequentially charged with positive voltages at the same time as scan pulses are supplied from the respective gate lines G1 and G2. An arrow shown in FIG. 2 indicates the charge sequence of the liquid crystal cells coupled to the data lines.

FIG. 3 shows the waveforms of charge voltages in the liquid crystal cells when the liquid crystal cells are charged in the direction of the arrow of FIG. 2. Referring to FIG. 3, the R liquid crystal cells coupled to the first or third gate line G1 or G3 are supplied with a positive voltage (or a negative voltage) which rises (or falls) from a negative voltage (or a positive voltage), and the G liquid crystal cells coupled to the second or fourth gate line G2 or G4 are supplied with a positive voltage (or a negative voltage) which changes from a positive voltage (or a negative voltage). Further, the B liquid crystal cells coupled to the first or third gate line G1 or G3 are supplied with a positive voltage (or a negative voltage) which rises (or falls) from a negative voltage (or a positive voltage), and the B liquid crystal cells coupled to the second or fourth gate line G2 or G4 are supplied with a positive voltage (or a negative voltage) which changes from a positive voltage (or a negative voltage). As known in the art, the amount of charge of liquid crystal cells to which a positive voltage rising from a negative voltage (or a negative voltage falling from a positive voltage) is supplied is smaller than the amount of charge of liquid crystal cells to which a positive voltage changing from a positive voltage (or a negative voltage changing from a negative voltage) is supplied. This is because the rising time of the positive voltage from the negative voltage (or the falling time of the negative voltage from the positive voltage) is long, whereas the rising time of the positive voltage from the positive voltage (or the falling time of the negative voltage from the negative voltage) is short.

Accordingly, in the conventional liquid crystal display using the DRD method, the amount of charge of liquid crystal cells coupled to odd-numbered gate lines (i.e., all the R liquid crystal cells and some of the B liquid crystal cells) is smaller than the amount of charge of liquid crystal cells coupled to even-numbered gate lines (i.e., all the G liquid crystal cells and the remaining B liquid crystal cells). In other words, the R liquid crystal cells are charged relatively weakly, the G liquid crystal cells are charged relatively strongly, and the B liquid crystal cells are alternately charged strongly/weakly on a pixel-by-pixel basis. Here, neither the weakly charged liquid crystal cells nor the strongly charged R and G liquid crystal cells are easily seen, but the alternately charged B liquid crystal cells are easily seen as a vertical line (DIM). Consequently, the conventional liquid crystal display driven using the DRD method is problematic in that picture quality is lowered because of the vertical line (DIM) of a specific color resulting from the difference in charge characteristic.

SUMMARY

An aspect of this document is to provide a liquid crystal display which is capable of improving picture quality by compensating for difference in charge characteristic through a selective level change using an analog gamma voltage.

In an aspect, a liquid crystal display comprises a liquid crystal display panel to which m/2 shared data lines and first and second gate lines are assigned in order to drive m liquid crystal cells arranged in the same horizontal line, pairs of adjacent liquid crystal cells being symmetrically connected to the first and second gate lines with a shared data line interposed therebetween; a gate driving circuit configured to sequentially supply scan pulses to the first and second gate lines; a charge difference compensation circuit configured to generate, in a specific gray level range, analog positive gamma voltages having a first reference level and analog negative gamma voltages having a second reference level in synchronization with a first scan time at which the first gate line is driven, and generate the analog positive gamma voltages having a first compensation level that is lower than the first reference level and the analog negative gamma voltages having a second compensation level that is higher than the second reference level in synchronization with a second scan time at which the second gate line is driven; and a data driving circuit configured to convert received digital video data into the analog positive gamma voltages or the analog negative gamma voltages in response to a polarity control signal which is inverted every 2 horizontal periods, and supply converted data to the data lines.

The charge difference compensation circuit may comprise a control signal generator configured to generate a compensation control signal for controlling an output timing of the gamma voltages in response to a source output enable signal necessary to drive the data driving circuit, and a gamma voltage controller configured to select output gamma voltages having the reference levels or the compensation levels in response to the compensation control signal.

The compensation control signal may have a logic level that is inverted in a cycle of 1 horizontal period.

The control signal generator may comprise a D flip-flop triggered in synchronization with rising edges of the source output enable signal.

The gamma voltage controller may comprise a gamma resistor string unit comprising a plurality of voltage-dividing resistors and a plurality of voltage-dividing nodes, wherein the plurality of voltage-dividing resistors is coupled in series between a high-power source voltage and a low-power source voltage, and each of a plurality of voltage-dividing nodes is formed between the resistors and configured to output respective gamma voltages having a corresponding level; and a switching unit comprising a plurality of switches, wherein each of the switches coupled to a voltage-dividing node corresponding to a specific gray level is selectively coupled to a first terminal configured to output the gamma voltages having the reference level, or a second terminal configured to output the gamma voltages having the compensation level, according to a logic level of the compensation control signal.

The specific gray level belongs to a gray level range having a gray level value of 25% to 75% of a peak white gray level.

Each of the switches is coupled to the first terminal during a period when the compensation control signal having a first logic level is generated, and to the second terminal during a period when the compensation control signal having a second logic level is generated.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Hereinafter, an implementation of this document will be described in detail with reference to FIGS. 4 through 11.

Figure 4:
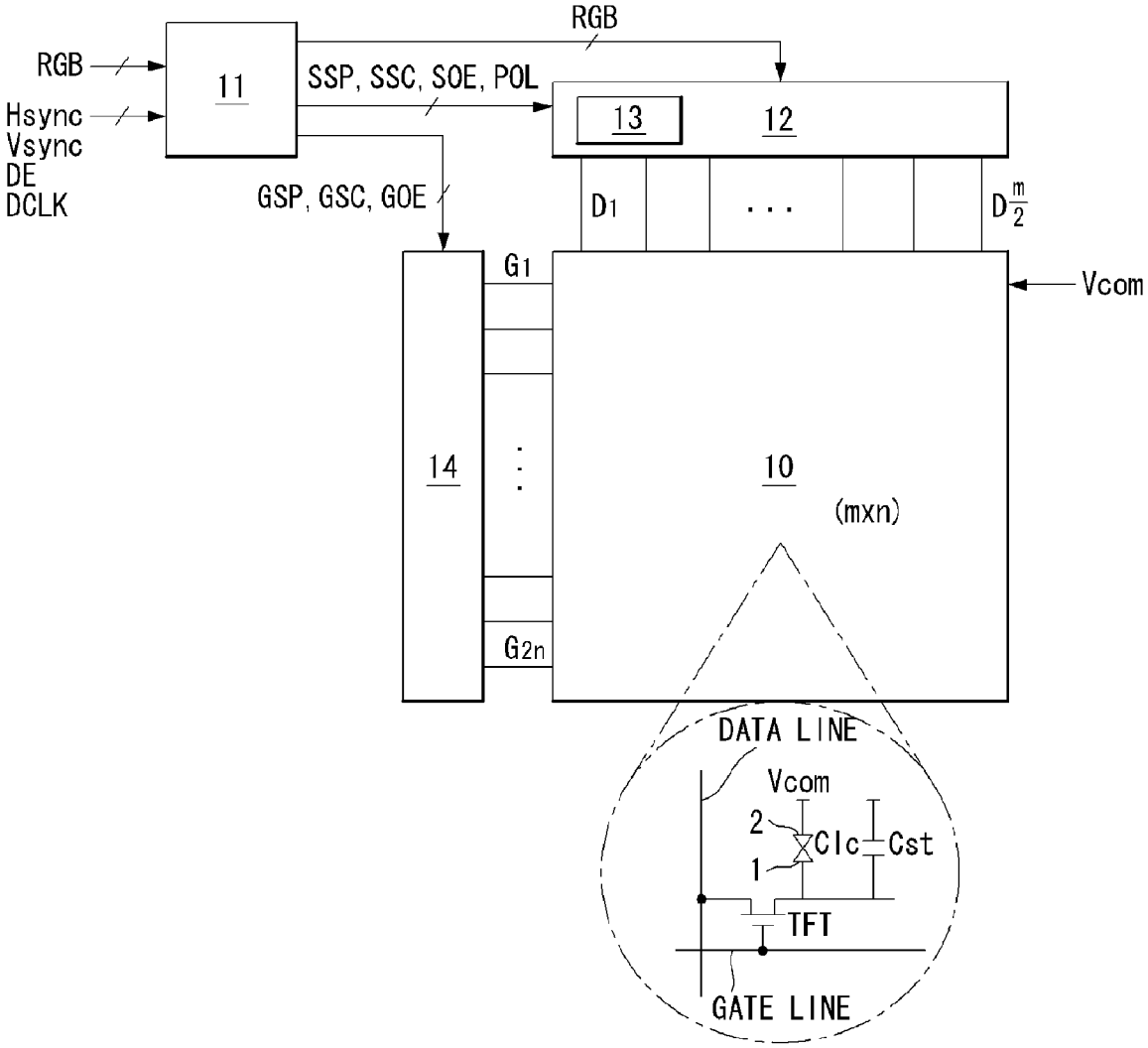
FIG. 4 is a block diagram of a liquid crystal display according to an embodiment of this document.

FIG. 4 is a block diagram of a liquid crystal display according to an embodiment of this document.

Referring to FIG. 4, the liquid crystal display according to the embodiment of this document includes a liquid crystal display panel 10, a timing controller 11, a data driving circuit 12, a charge difference compensation circuit 13, and a gate driving circuit 14.

The liquid crystal display panel 10 has a liquid crystal layer formed between two glass substrates. The liquid crystal display panel 10 comprises m×n liquid crystal cells Clc and is driven using a DRD method. The liquid crystal cells are arranged in a matrix formed by m/2 data lines D1 to $$D\frac{m}{2}$$

and 2n (n is a natural number) gate lines G1 to G2n. The data lines D1 to $$D\frac{m}{2},$$

the gate lines G1 to G2n, TFTs, and storage capacitors Cst are formed on the rear glass substrate of the liquid crystal display panel 10. Each of the liquid crystal cells Clc is coupled to a TFT and driven using an electric field between a pixel electrode 1 and a common electrode 2. Black matrices, color filters, and the common electrodes 2 are formed on the front glass substrate of the liquid crystal display panel 10. The common electrode 2 is formed on the front glass substrate to implement a vertical electric field driving method, such as a twisted nematic (TN) mode or a vertical alignment (VA) mode, and, together with the pixel electrode 1, is formed on the rear glass substrate to implement a horizontal electric field driving method, such as an in-plane switching (IPS) mode or a fringe field switching (FFS) mode. A polarization plate is attached to each of the front glass substrate and the rear glass substrate of the liquid crystal display panel 10, and an orientation film for setting the pre-tilt angle of liquid crystal is formed therein.

The liquid crystal cells Clc may comprise a number of R liquid crystal cells, G liquid crystal cells, and B liquid crystal cells. The connection structure of the liquid crystal cells Clc is described below with reference to FIG. 2. In the first horizontal line HL1, the R(+) liquid crystal cell coupled to the first gate line G1 is adjacent to the G(+) liquid crystal cell coupled to the second gate line G2, and is coupled in common to the first data line D1 along with the G(+) liquid crystal cell; the B(−) liquid crystal cell coupled to the second gate line G2 is adjacent to the R(−) liquid crystal cell coupled to the first gate line G1, and is coupled in common to the second data line D2 along with the R(−) liquid crystal cell; and the G(+) liquid crystal cell coupled to the second gate line G2 is adjacent to the B(+) liquid crystal cell coupled to the first gate line G1 and is coupled in common to the third data line D3 along with the B(+) liquid crystal cell. Further, in the second horizontal line HL2, the R(−) liquid crystal cell coupled to the third gate line G3 is adjacent to the G(−) liquid crystal cell coupled to the fourth gate line G4, and is coupled in common to the first data line D1 along with the G(−) liquid crystal cell; the B(+) liquid crystal cell coupled to the fourth gate line G4 is adjacent to the R(+) liquid crystal cell coupled to the third gate line G3, and is coupled in common to the second data line D2 along with the R(+) liquid crystal cell; and the G(−) liquid crystal cell coupled to the fourth gate line G4 is adjacent to the B(−) liquid crystal cell coupled to the third gate line G3, and is coupled in common to the third data line D3 along with the B(−) liquid crystal cell. Here, the (+) liquid crystal cells indicate liquid crystal cells charged with a positive voltage having an electric potential higher than the common voltage Vcom, and the (−) liquid crystal cells indicate liquid crystal cells charged with a negative voltage having an electric potential lower than the common voltage Vcom. Accordingly, the R(+) liquid crystal cell and the G(+) liquid crystal cell sharing the first data line D1, among the liquid crystal cells arranged in the first horizontal line HL1, are sequentially charged with a positive polarity at the same time as scan pulses are supplied from the respective gate lines G1 and G2, the R(−) liquid crystal cell and the B(−) liquid crystal cell sharing the second data line D2, among the liquid crystal cells, are sequentially charged with a negative polarity at the same time as scan pulses are supplied from the respective gate lines G1 and G2, and the B(+) liquid crystal cell and the G(+) liquid crystal cell sharing the third data line D3, among the liquid crystal cells, are sequentially charged with a positive polarity at the same time as scan pulses are supplied from the respective gate lines G1 and G2. Further, the R(−) liquid crystal cell and the G(−) liquid crystal cell sharing the first data line D1, among the liquid crystal cells arranged in the second horizontal line HL2, are sequentially charged with a negative polarity at the same time as scan pulses are supplied from the respective gate lines G3 and G4, the R(+) liquid crystal cell and the B(+) liquid crystal cell sharing the second data line D2, among the liquid crystal cells, are sequentially charged with a positive polarity at the same time as scan pulses are supplied from the respective gate lines G3 and G4, and the B(−) liquid crystal cell and the G(−) liquid crystal cell sharing the third data line D3, among the liquid crystal cells, are sequentially charged with a negative polarity at the same time as scan pulses are supplied from the respective gate lines G3 and G4.

The timing controller 11 is configured to generate a data control signal to control an operation timing of the data driving circuit 12, and a gate control signal to control an operation timing of the gate driving circuit 14 using timing signals, such as a horizontal sync signal Hsync, a vertical sync signal Vsync, a data enable signal DE, and a dot clock DCLK supplied from a system (not shown). The data control signal comprises a source start pulse SSP to indicate a sampling start point of digital video data RGB within the data driving circuit 12, a source sampling clock SSC to indicate the latch operation of the digital video data RGB within the data driving circuit 12 on the basis of a rising edge or a falling edge, a source output enable signal SOE to indicate the output of the data driving circuit 12, and a polarity control signal POL to indicate the polarity of data voltages to be supplied to the liquid crystal cells Clc of the liquid crystal display panel 210. The gate control signal comprises a gate start pulse GSP to indicate a start horizontal line at which scanning begins during 1 vertical period in which one screen is displayed, a gate shift clock signal GSC (i.e., a timing control signal), and a gate output enable signal GOE to indicate the output of the gate driving circuit 14. The gate shift clock signal GSC is input to the shift register of the gate driving circuit 14, configured to sequentially shift the gate start pulse GSP, and generated with a pulse width corresponding to the ON period of a TFT.

The timing controller 11 realigns the digital video data RGB received from the system according to the resolution of the liquid crystal display panel 10 and supplies the data driving circuit 12 with the resulting data.

The data driving circuit 12 latches the digital video data RGB under the control of the timing controller 11. Further, the data driving circuit 12 converts the digital video data RGB into analog positive and negative gamma voltages according to a polarity control signal POL and supplies the resulting data voltages to the data lines D1 to $$D\frac{m}{2}.$$

Figure 5:
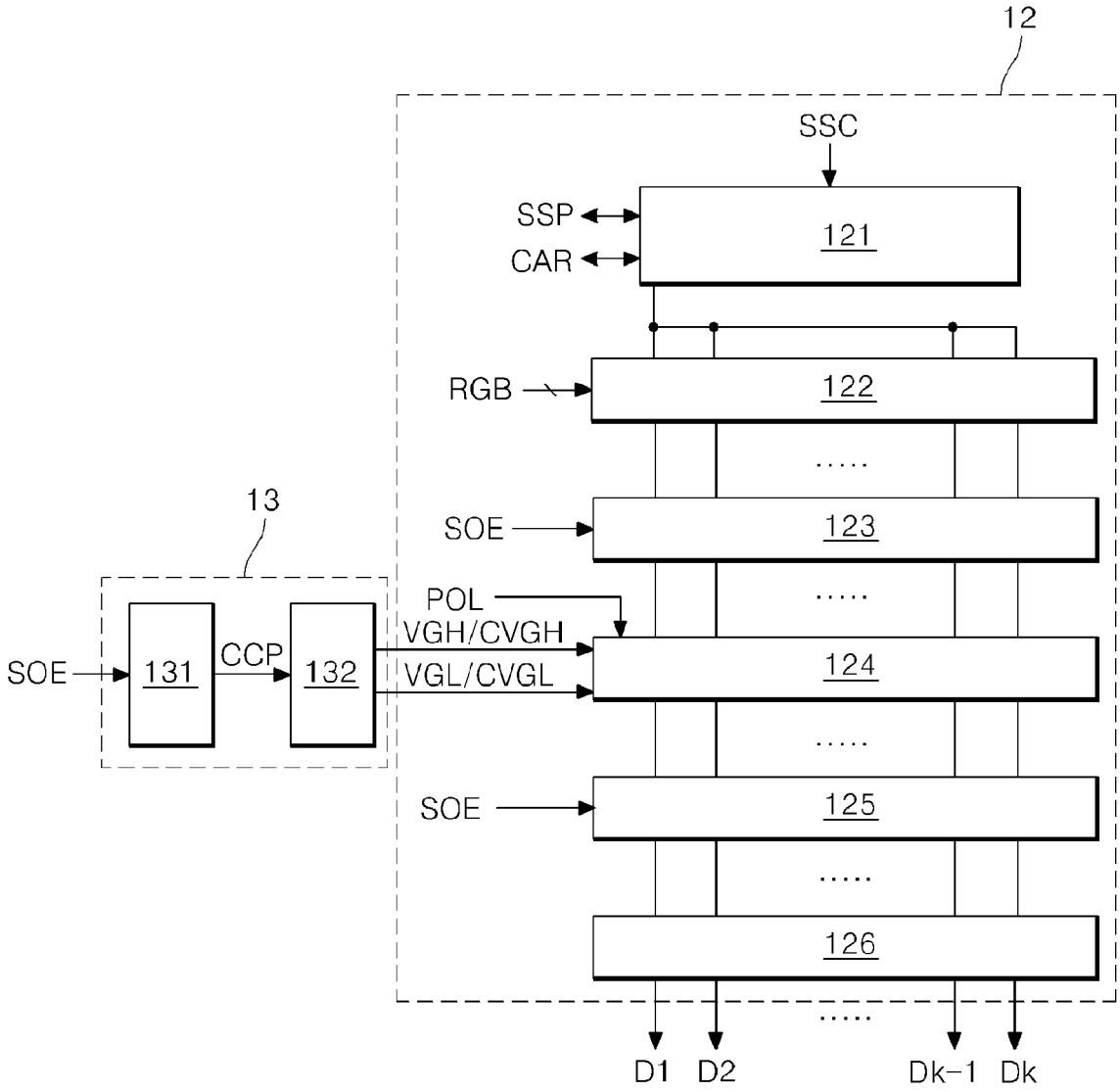
FIGS. 5 and 6 are diagrams showing in detail one of data drive ICs constituting a data driving circuit.

To this end, the data driving circuit 12 comprises a plurality of data drive ICs as shown in FIG. 5.

The charge difference compensation circuit 13 generates an analog positive gamma voltage at a reference level, which will be synchronized with an odd-numbered scan time, and an analog positive gamma voltage at a compensation level that is lower than the reference level, which will be synchronized with an even-numbered scan time, in a specific gray level range under the control of the timing controller 11, and supplies the gamma voltages to the data driving circuit 12. Further, the charge difference compensation circuit 13 generates an analog negative gamma voltage at a reference level, which will be synchronized with an odd-numbered scan time, and an analog negative gamma voltage at a compensation level that is higher than the reference level, which will be synchronized with an even-numbered scan time, in a specific gray level range under the control of the timing controller 11, and supplies the gamma voltages to the data driving circuit 12. The charge difference compensation circuit 13 may be included in the data driving circuit 12. It is hereinafter assumed that the charge difference compensation circuit 13 is included in the data driving circuit 12.

The gate driving circuit 14 generates scan pulses to select the horizontal lines of the liquid crystal display panel 10 to which analog data voltages will be supplied under the control of the timing controller 11, and sequentially supplies the scan pulses to the gate lines G1 to G2n. To this end, the gate driving circuit 14 comprises the plurality of gate drive ICs. Each of the gate drive ICs comprises a shift register, a level shifter for converting the output signal of the shift register into a signal having a swing width suitable to drive the TFT of the liquid crystal cell Clc, and an output circuit coupled between the level shifter and the gate line.

Figure 6:
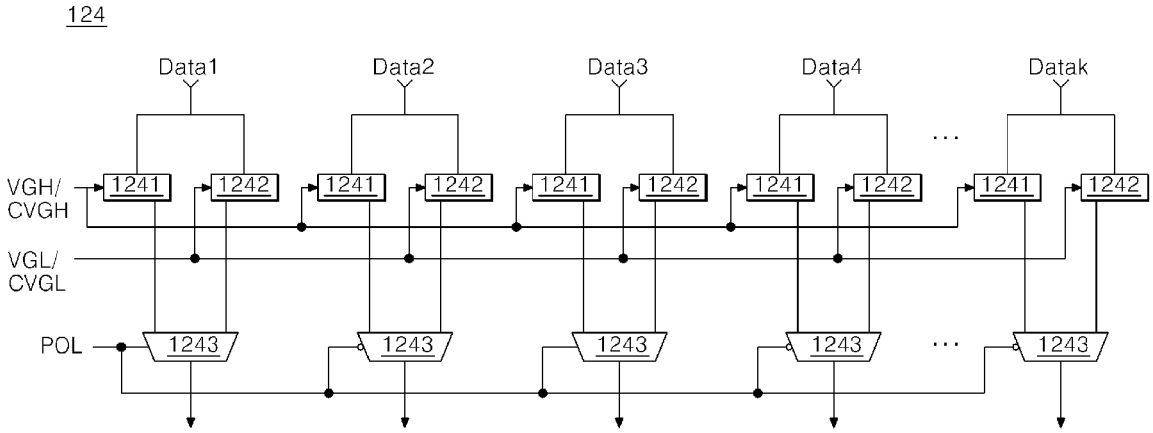

FIGS. 5 and 6 are diagrams showing in detail one of the data drive ICs constituting the data driving circuit.

Referring to FIG. 5, the data drive IC comprises a shift register 121, a first latch array 122, a second latch array 123, a charge difference compensation circuit 13, a digital/analog converter (hereinafter referred to as a 'DAC') 124, a charge sharing circuit 125, and an output circuit 126.

The shift register 121 generates a sampling signal by shifting the source start pulse SSP, received from the timing controller 11, in response to the source shift clock signal SSC. Further, the shift register 121 shifts the source start pulse SSP and sends a carry signal CAR to the shift register of a next stage.

The first latch array 122 samples the digital video data RGB, received from the timing controller 11, in response to the sampling signals sequentially received from the shift register 121, latches the data RGB every 1 horizontal line, and outputs the data RGB of each 1 horizontal line at the same time.

The second latch array 123 latches data of every 1 horizontal line, received from the first latch array 122, and outputs the latched digital video data RGB at the same time as the second latch array of the data drive ICs during a logic low period of the source output enable signal SOE.

The charge difference compensation circuit 13 comprises a control signal generator 131 and a gamma voltage controller 132 and generates a positive gamma voltage VGH having a reference level and a positive gamma voltage CVGH having a compensation level, and a negative gamma voltage VGL having a reference level and a negative gamma voltage CVGL having a compensation level. The control signal generator 131 generates the compensation control signal CCP to control output timing of the positive gamma voltage VGH of the reference level and the positive gamma voltage CVGH of the compensation level, and output timing of the negative gamma voltage VGL of the reference level and the negative gamma voltage CVGL of the compensation level, in response to the source output enable signal SOE of the timing controller 11. The gamma voltage controller 132 switches in response to the compensation control signal CCP to select gamma voltages to be synchronized with an odd-numbered scan time during a specific gray level range as the positive/negative gamma voltages VGH and VGL having a reference level, and gamma voltages to be synchronized with an even-numbered scan time as the positive/negative gamma voltages CVGH and CVGL having a compensation level. This charge difference compensation circuit 13 is described in detail later with reference to FIGS. 7 to 11.

The DAC 124, as shown in FIG. 6, comprises a P-decoder PDEC 1241 to which the positive gamma voltages VGH and CVGH respectively having the reference level and the compensation level are supplied, an N-decoder NDEC 1242 to which the negative gamma voltages VGL and CVGL respectively having the reference level and the compensation level are supplied, and a multiplexer 1243 configured to select the output of the P-decoder 1241 and the output of the N-decoder 1242 in response to the polarity control signal POL. The P-decoder 1241 decodes the digital video data RGB received from the second latch array 123 and outputs the positive gamma voltage VGH or CVGH having the reference level or the compensation level corresponding to a gray level value of the decoded data. The N-decoder 1242 decodes the digital video data RGB received from the second latch array 123 and outputs the negative gamma voltage VGL or CVGL having the reference level or the compensation level corresponding to a gray level value of the decoded data. The multiplexer 1243 selects any one of the positive gamma voltages VGH/CVGH and the negative gamma voltages VGL/CVGL in response to the polarity control signal POL.

The charge sharing circuit 125 shorts neighboring data output channels during a high logic period of the source output enable signal SOE and outputs the mean value of neighboring data voltages as a charge share voltage or supplies the common voltage Vcom to the data output channels during a high logic period of the source output enable signal SOE, thereby reducing an abrupt change in the positive data voltage and the negative data voltage.

The output circuit 126 comprises a buffer and functions to minimize the signal attenuation of analog data voltages received from data lines D1 to Dk.

Figure 7:
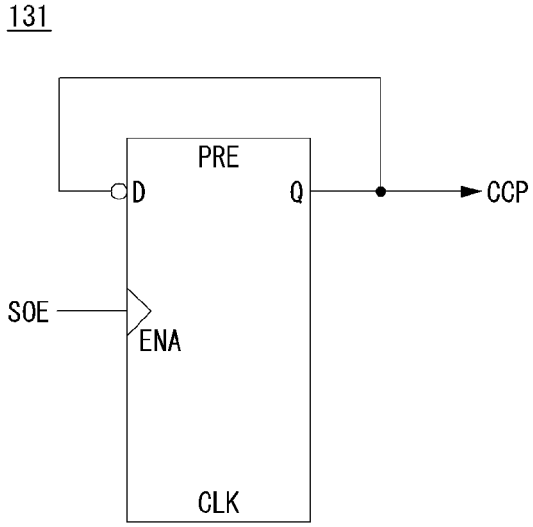
FIG. 7 is a diagram showing in detail a control signal generator of FIG. 5.
Figure 8:
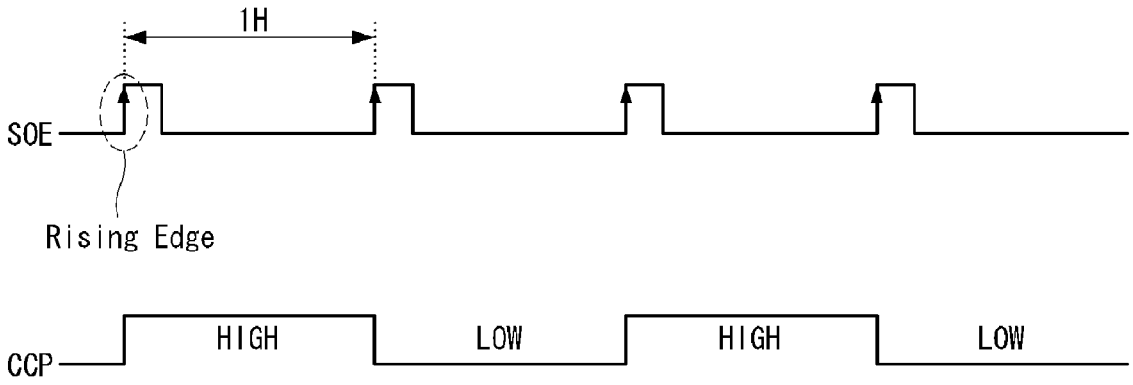
FIG. 8 shows a waveform of a compensation control signal generated by the control signal generator.

FIG. 7 is a diagram showing in detail the control signal generator 131 of FIG. 5, and FIG. 8 shows a waveform of the compensation control signal CCP generated by the control signal generator 131.

Referring to FIG. 7, the control signal generator 131 comprises a D flip-flop which is edge-triggered. The D flip-flop delays an input signal received via an input terminal D as long as the time delay of the source output enable signal SOE and outputs the resulting signal to an output terminal Q. Accordingly, the control signal generator 131 is triggered in synchronization with the rising edges of the source output enable signal SOE generated in a cycle of approximately 1 horizontal period 1H, thus generating the compensation control signal CCP alternately having a first logic level HIGH and a second logic level LOW in a cycle of approximately 1 horizontal period 1H, as shown in FIG. 8. Accordingly, the compensation control signal CCP may be synchronized with different logic levels when the odd-numbered gate lines and the even-numbered gate lines are scanned. For example, the compensation control signal CCP may be generated with the first logic level HIGH in synchronization with scanning of the odd-numbered gate lines, or with the second logic level LOW in synchronization with scanning of the even-numbered gate lines.

Figure 9:
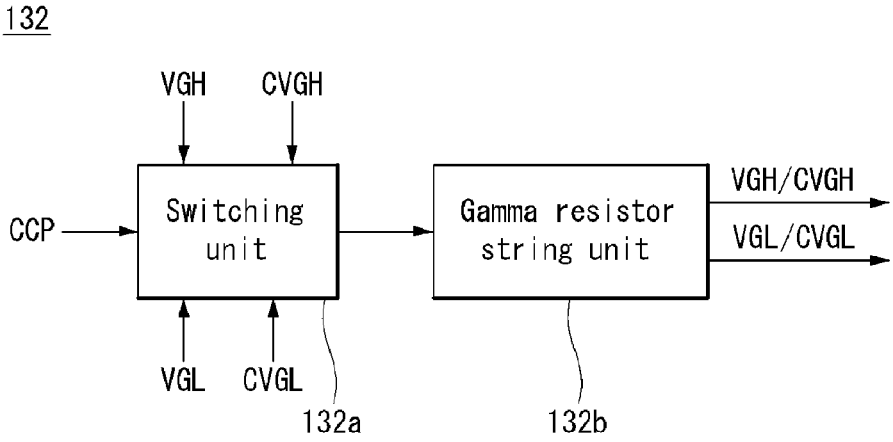
FIGS. 9 and 10 are circuit diagrams showing in detail a gamma voltage controller of FIG. 5.
Figure 10:
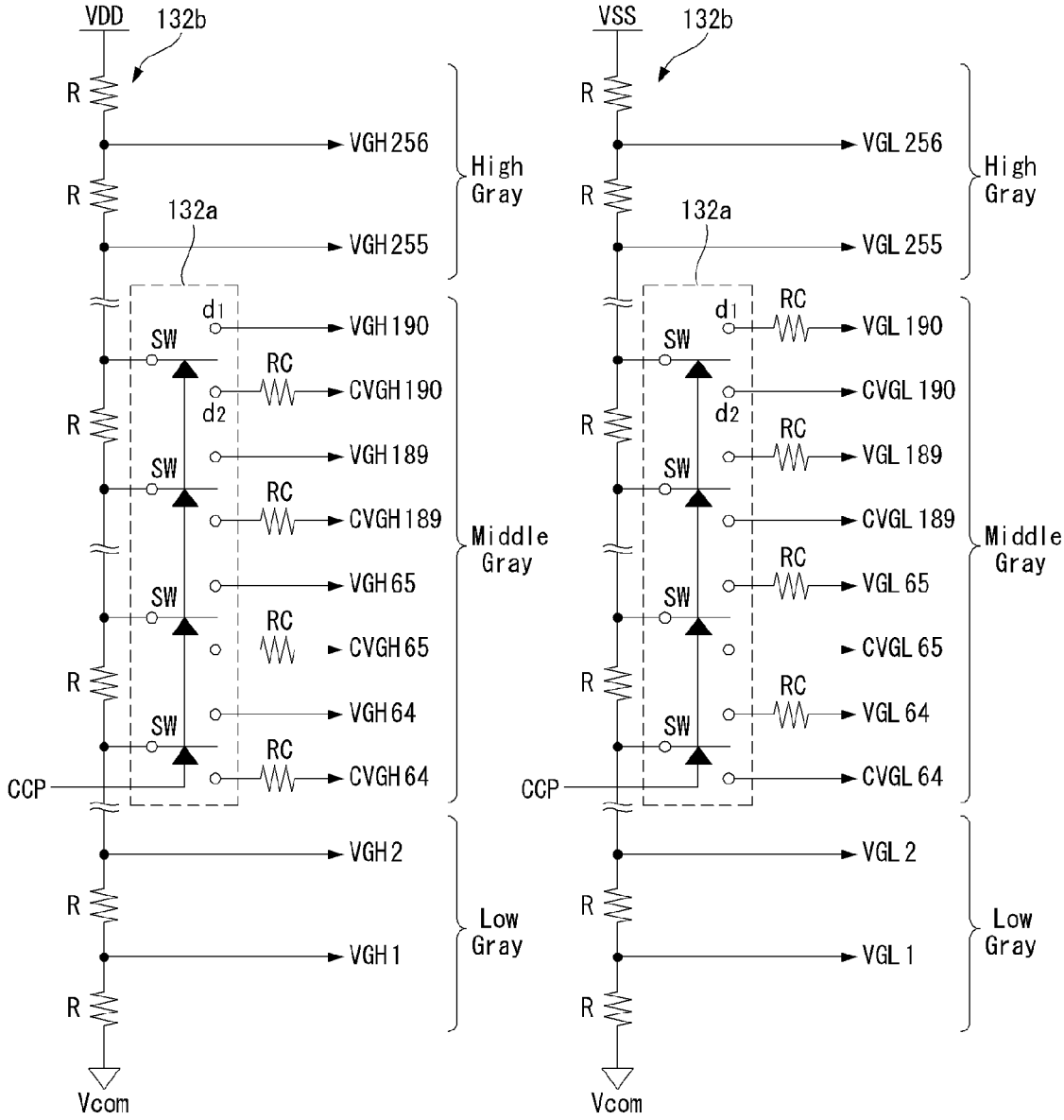

FIGS. 9 and 10 are circuit diagrams showing in detail the gamma voltage controller 132 of FIG. 5.

Referring to FIGS. 9 and 10, the gamma voltage controller 132 comprises a switching unit 132*a* and a gamma resistor string unit 132*b*.

The gamma resistor string unit 132*b* comprises a resistor string having a plurality of voltage-dividing resistors R connected in series between a high-power source voltage VDD and a low-power source voltage VSS, and a plurality of voltage-dividing nodes formed between the resistors R and configured to output respective gamma voltages each having a corresponding level. The gamma resistor string unit 132*b* generates positive gamma voltages VGH1 to VGH256 having a reference level corresponding to the number of gray levels (for example, 256) which can be expressed using the number of bits (for example, 8 bits) of the digital video data RGB, and negative gamma voltages VGL1 to VGL256 having a reference level corresponding to the number of gray levels. In particular, the gamma resistor string unit 132*b* selectively generates positive/negative gamma voltages CVGH64 to CVGH190 and CVGL64 to CVGL190, having a compensation level, along with the positive/negative gamma voltages VGH64 to VGH190 and VGL64 to VGL190 having a corresponding reference level, corresponding to intermediate gray level range 64 Gray to 190 Gray having a gray level value of approximately 25% to 75% of a peak white gray level. Here, the reason why a specific gray level range where the gamma voltages having the compensation level is set to have the gray level value of approximately 25% to 75% of the peak white gray level is that effects such as a longitudinal dim defect within a gray level range are considerable. It is however to be noted that the specific gray level range may be wider or narrower than the illustrated range.

The switching unit 132*a* comprises a plurality of switches SW selectively coupled to a first terminal d1 and a second terminal d2. The first terminal d1 is coupled to a voltage-dividing node corresponding to an intermediate gray level and configured to output positive/negative gamma voltages having a reference level according to a logic level of the compensation control signal CCP. The second terminal d2 is configured to output positive/negative gamma voltages having a compensation level. Each of the switches SW is coupled to the first terminal d1 during a period in which the compensation control signal CCP having the first logic level HIGH is generated, and to the second terminal d2 during a period in which the compensation control signal CCP having the second logic level LOW is generated. Here, the positive gamma voltage of the compensation level has an electric potential which is lower than the positive gamma voltage of the reference level by a charge difference, and the negative gamma voltage of the compensation level has an electric potential which is higher than the negative gamma voltage of the reference level by a charge difference. The charge difference refers to a difference between the amount of charge of a positive voltage rising from a negative voltage (or a negative voltage falling from a positive voltage) and the amount of charge of a positive voltage changing from a positive voltage (or a negative voltage changing from a negative voltage).

Figure 1:
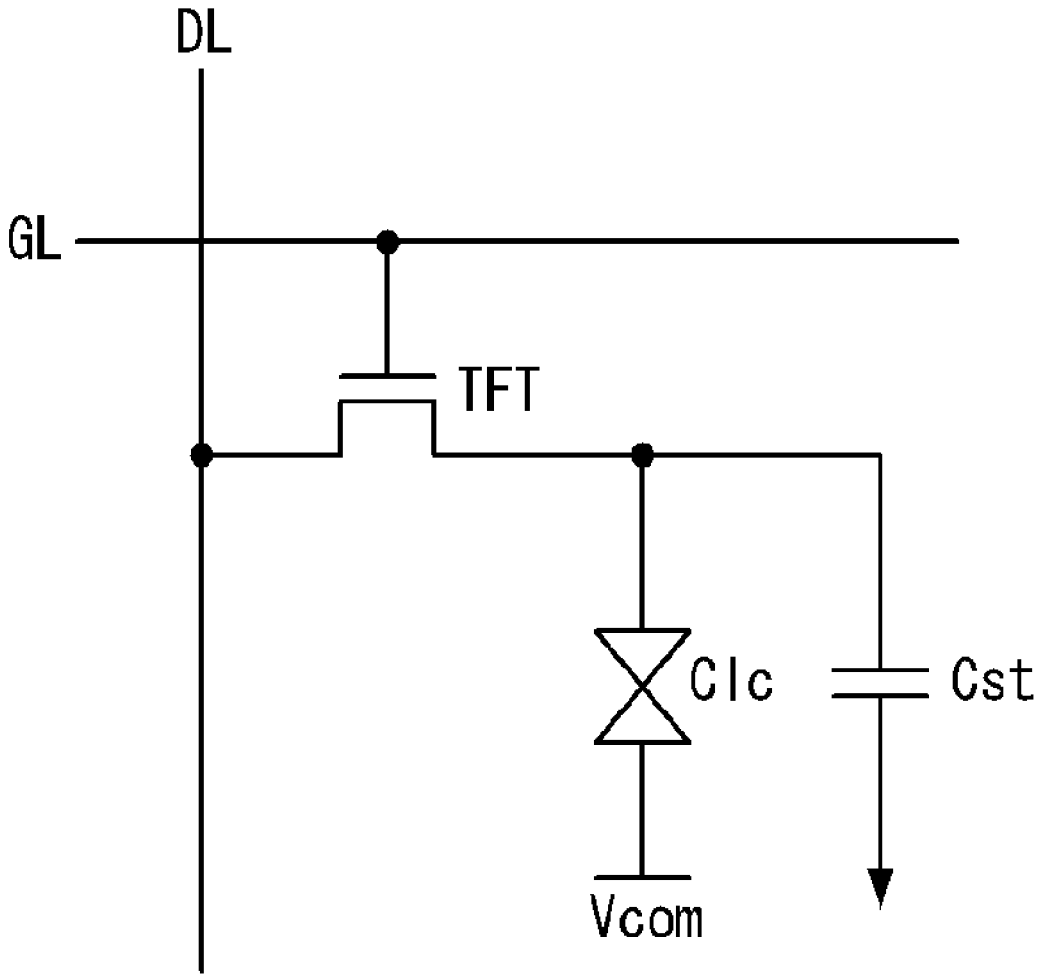
FIG. 1 (Related Art)
FIG. 1 is an equivalent circuit diagram showing a pixel of a typical liquid crystal display.
Figure 2:
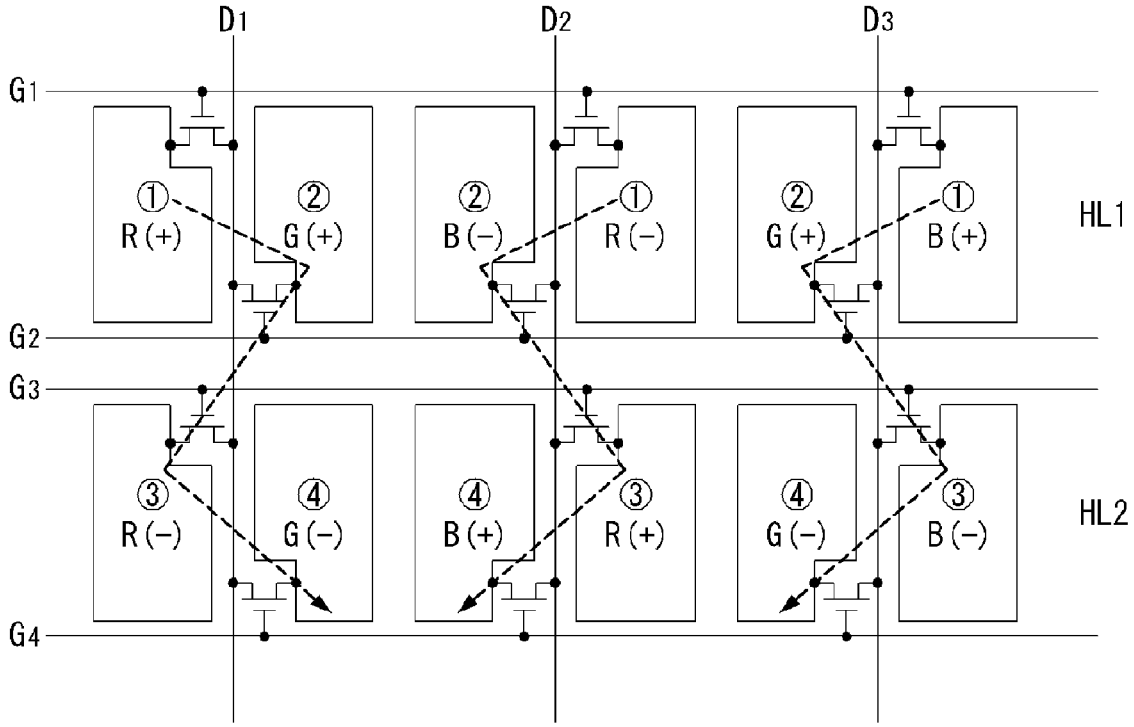
FIG. 2 (Related Art)
FIG. 2 is a diagram showing a conventional liquid crystal display driven using a DRD method.
Figure 3:
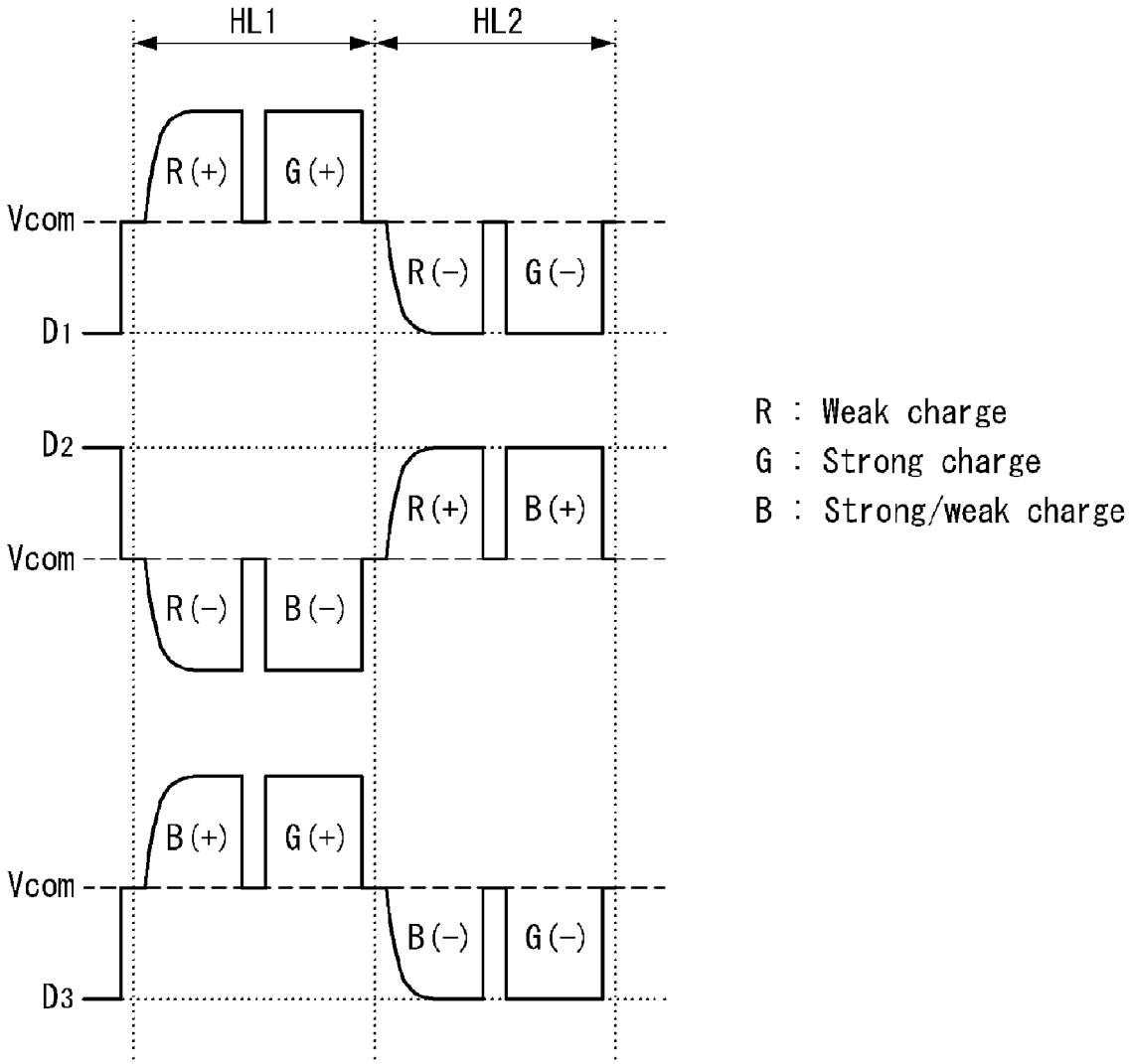
FIG. 3 (Related Art)
FIG. 3 is a diagram showing charge voltage waveforms in each of liquid crystal cells when the cells are charged in the direction of an arrow of FIG. 2.
Figure 11:
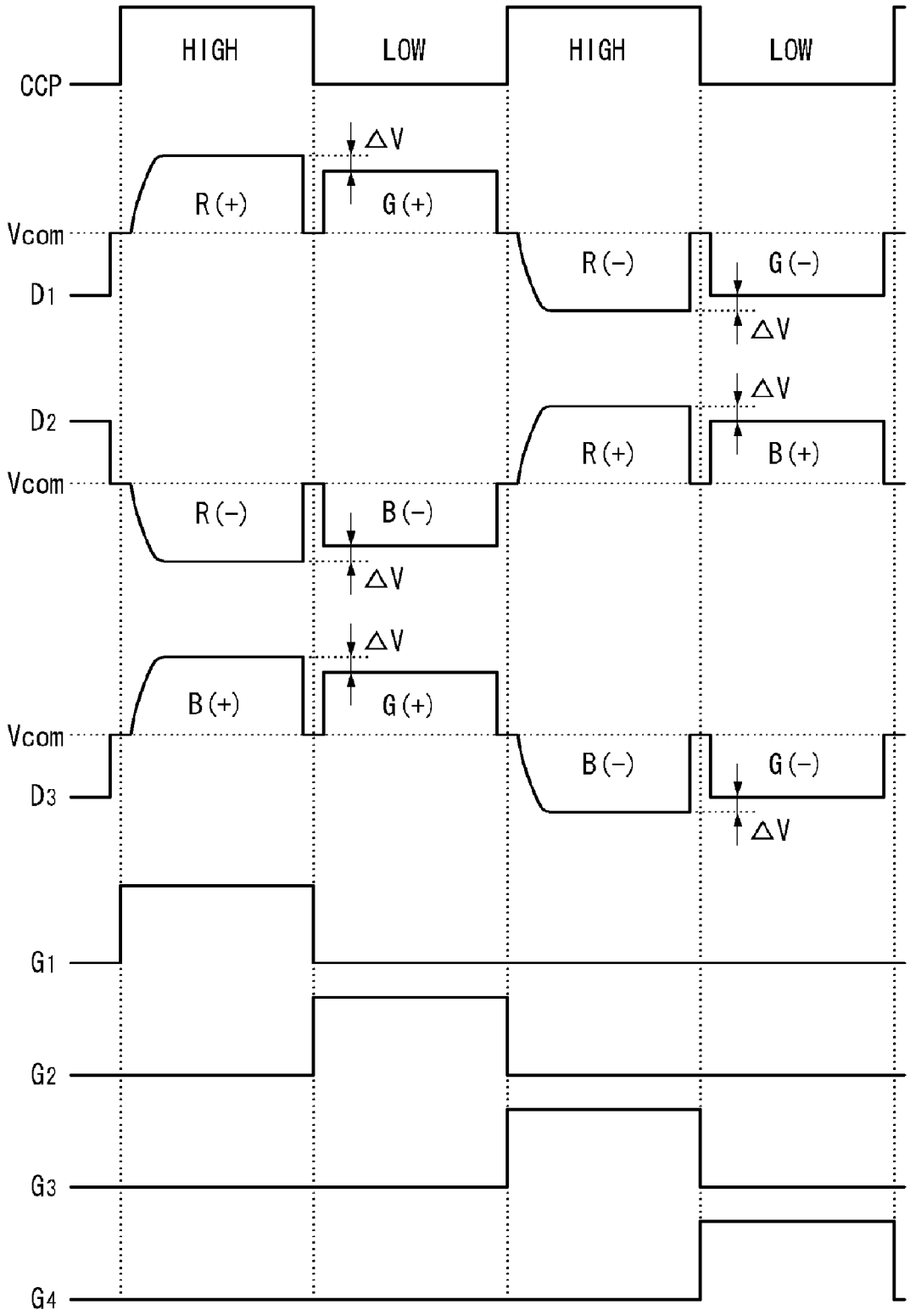
FIG. 11 are waveforms showing compensation for a difference in charge characteristic between liquid crystal cells arranged in first and second horizontal lines of FIG. 2.

FIG. 11 are waveforms showing compensation for a difference in charge characteristic between liquid crystal cells arranged in the first and second horizontal lines HL1 and HL2 of FIG. 2.

Referring to FIG. 11, liquid crystal cells driven in synchronization with odd-numbered scan times G1 and G3 are charged with a positive data voltage having a reference level or a negative data voltage having a reference level in response to the compensation control signal CCP having the first logic level HIGH. On the other hand, liquid crystal cells driven in synchronization with even-numbered scan times G2 and G4 are charged with a positive data voltage that is lower than a reference level by a charge difference ΔV, or a negative data voltage that is higher than a reference level by the charge difference ΔV, in response to the compensation control signal CCP having the second logic level LOW. Accordingly, a longitudinal dim effect, occurring because of a difference between the amount of charge of a positive voltage rising from a negative voltage (or a negative voltage falling from a positive voltage) and the amount of charge of a positive voltage changing from a positive voltage (or a negative voltage changing from a negative voltage), can be prevented effectively.

As described above, the liquid crystal display according to this document can significantly improve picture quality by compensating for difference in charge characteristic through selective level change of an analog gamma voltage.

While this document has been described in connection with what are presently considered to be practical exemplary embodiments, it is to be understood that this document is not limited to the disclosed embodiments, but, on the contrary, is intended to cover various modifications and equivalent arrangements included within the spirit and scope of the appended claims.

What is claimed is:

1. A liquid crystal display, comprising:

a liquid crystal display panel to which m/2 shared data lines and first and second gate lines are assigned in order to drive m liquid crystal cells arranged in the same horizontal line, pairs of adjacent liquid crystal cells being symmetrically connected to the first and second gate lines with a shared data line interposed therebetween;

a gate driving circuit configured to sequentially supply scan pulses to the first and second gate lines;

a charge difference compensation circuit configured to generate, in a specific gray level range, analog positive gamma voltages having a first reference level and analog negative gamma voltages having a second reference level in synchronization with a first scan time at which the first gate line is driven, and generate the analog positive gamma voltages having a first compensation level that is lower than the first reference level and the analog negative gamma voltages having a second compensation level that is higher than the second reference level in synchronization with a second scan time at which the second gate line is driven; and a data driving circuit configured to convert received digital video data into the analog positive gamma voltages or the analog negative gamma voltages in response to a polarity control signal which is inverted every 2 horizontal periods, and supply converted data to the data lines, wherein the specific gray level belongs to a gray level range having a gray level value of 25% to 75% of a peak white gray level, wherein the charge difference compensation circuit comprises a control signal generator configured to generate a compensation control signal for controlling an output timing of the gamma voltages in response to a source output enable signal necessary to drive the data driving circuit; and a gamma voltage controller configured to select output gamma voltages having the reference levels or the compensation levels in response to the compensation control signal, wherein the gamma voltage controller comprises a gamma resistor string unit comprising a plurality of voltage-dividing resistors and a plurality of voltage-dividing nodes, wherein the plurality of voltage-dividing resistors is coupled in series between a high-power source voltage and a low-power source voltage, and each of a plurality of voltage-dividing nodes is formed between the resistors and configured to output respective gamma voltages having a corresponding level; and a switching unit comprising a plurality of switches, wherein each of the switches only coupled to a voltage-dividing node corresponding to a specific gray level is selectively coupled to a first terminal configured to output the gamma voltages having the reference level, or a second terminal configured to output the gamma voltages having the compensation level, according to a logic level of a compensation control signal.

2. The liquid crystal display of claim 1, wherein the compensation control signal has a logic level that is inverted in a cycle of 1 horizontal period.

3. The liquid crystal display of claim 1, wherein the control signal generator comprises a D flip-flop triggered in synchronization with rising edges of the source output enable signal.

4. The liquid crystal display of claim 1, wherein each of the switches is coupled to the first terminal during a period when the compensation control signal having a first logic level is generated, and to the second terminal during a period when the compensation control signal having a second logic level is generated.

* * * * *